US012758860B2

(12) United States Patent
Shim et al.

(10) Patent No.: US 12,758,860 B2
(45) Date of Patent: Oct. 13, 2026

(54) BOARD GAME AND SYSTEM FOR CARBON NEUTRALITY EDUCATION

(71) Applicant: National Institute of Meteorological Sciences, Seogwipo-si (KR)

(72) Inventors: Sung Bo Shim, Seogwipo-si (KR); Jong Chul Ha, Seogwipo-si (KR); Young Hwa Byun, Seogwipo-si (KR); Hyun Min Sung, Seogwipo-si (KR); Jin-Uk Kim, Seogwipo-si (KR); Yeon-Hee Kim, Seogwipo-si (KR)

(73) Assignee: NATIONAL INSTITUTE OF METEOROLOGICAL SCIENCES, Seogwipo-si (KR)

( * ) Notice: Subject to any disclaimer, the term of this patent is extended or adjusted under 35 U.S.C. 154(b) by 1261 days.

(21) Appl. No.: 17/666,786

(22) Filed: Feb. 8, 2022

(65) Prior Publication Data

US 2022/0296990 A1 Sep. 22, 2022

(30) Foreign Application Priority Data

Mar. 22, 2021 (KR) ..... 10-2021-0036890

(51) Int. Cl.
*A63F 3/04* (2006.01)
*A63F 1/02* (2006.01)
*A63F 3/00* (2006.01)

(52) U.S. Cl.
CPC ..... *A63F 3/0478* (2013.01); *A63F 1/02* (2013.01); *A63F 3/00697* (2013.01); *A63F 2003/0484* (2013.01)

(58) Field of Classification Search
None
See application file for complete search history.

(56) References Cited

U.S. PATENT DOCUMENTS 345,430 A * 7/1886 Hayward et al. ... A63F 3/00031 273/244.1
2,026,082 A * 12/1935 Darrow ..... A63F 3/00072 D21/350

(Continued)

FOREIGN PATENT DOCUMENTS

AU 703022 B3 * 3/1999
GB 2237216 A * 5/1991 ..... A63F 3/00088

(Continued)

OTHER PUBLICATIONS

The Dicey Review, CO2 Second Chance: Cooperative Game—A Dicey Walkthrough!, May 15, 2019, https://www.youtube.com/watch?v=IDYS9DyNyxl , p. 1 (Year: 2019).*

(Continued)

*Primary Examiner* — Tramar Harper
(74) *Attorney, Agent, or Firm* — CANTOR COLBURN LLP

(57) ABSTRACT

Proposed is a board game system for carbon neutrality education including: a game display unit including a game board, general cards having carbon cards on which carbon emission quantities are indicated and environment cards on which carbon absorption quantities are indicated, disaster cards on which climate crisis disasters are indicated, convention cards on which rights to change greenhouse gas target amounts are indicated, earth money cards on which scores are indicated, and an indicator for indicating the level of global warming and carbon emission targets; and a game control unit for controlling the game display unit to display the general cards, the disaster cards, the convention cards, the earth money cards, or the indicator on the game board.

7 Claims, 13 Drawing Sheets

(56) References Cited

U.S. PATENT DOCUMENTS 2,174,058 A * 9/1939 McGennis ..... A63F 3/00069 40/109
2,780,463 A * 2/1957 Salomon ..... A63F 3/00072 273/249
3,737,167 A * 6/1973 Kelley ..... A63F 3/00 273/243
3,785,654 A * 1/1974 Chambers ..... A63F 3/001 273/249
3,942,800 A * 3/1976 Holbrook ..... A63F 3/0449 273/285
4,032,154 A * 6/1977 Magiera ..... A63F 3/00072 273/256
4,522,407 A * 6/1985 Hatherley ..... A63F 3/00072 273/256
4,625,970 A * 12/1986 Childs ..... A63F 3/00138 273/257
4,893,819 A * 1/1990 Wright ..... A63F 3/00006 273/243
6,527,273 B1 * 3/2003 Dixson ..... A63F 3/00088 273/254
7,198,271 B1 * 4/2007 Thomas ..... A63F 3/00 273/272
8,439,734 B2 * 5/2013 Kasai ..... A63F 3/00643 463/9
8,894,067 B2 11/2014 Futrell, III et al.
2002/0153660 A1 * 10/2002 Kyrollos ..... A63F 3/00069 273/278
2006/0175753 A1 * 8/2006 MacIver ..... A63F 3/00643 463/43
2007/0200293 A1 * 8/2007 Gomez ..... A63F 3/00006 273/242
2008/0290599 A1 * 11/2008 DeLaCruz-Newlan ..... A63F 3/00006 273/256
2009/0020948 A1 * 1/2009 Garcia ..... A63F 3/00138 273/257
2010/0047746 A1 * 2/2010 Goodrich ..... G09B 3/00 434/129
2010/0081114 A1 4/2010 Goodrich et al.
2011/0042895 A1 * 2/2011 Godsmark ..... A63F 3/0478 273/243
2012/0018950 A1 * 1/2012 Kingsley ..... A63F 3/00643 273/272
2015/0141124 A1 5/2015 Amaitis et al.

FOREIGN PATENT DOCUMENTS

JP 2013034623 A 2/2013
KR 20220009076 A * 1/2022 ..... A63F 1/04
KR 20230101160 A * 7/2023 ..... A63F 1/04
KR 102826702 B1 * 6/2025 ..... A63F 1/04
WO WO-2008067619 A1 * 6/2008 ..... A63F 3/00063
WO 2017052476 3/2017

OTHER PUBLICATIONS

European Search Report—European Application No. 22156737.3 issued on Aug. 9, 2022, citing U.S. Pat. No. 8,894,067, US 2010/0081114, WO 2017/052476, and US 2015/0141124.

* cited by examiner

BOARD GAME AND SYSTEM FOR CARBON NEUTRALITY EDUCATION

BACKGROUND OF THE INVENTION

Field of the Invention

The present invention relates to a board game for carbon neutrality education, and a board game method and a board game system for carbon neutrality education, and more particularly, to a board game for carbon neutrality education, and a board game method and a board game system for carbon neutrality education, which can make players be aware of the risk of global warming, learn the concept of carbon neutrality by establishing a strategy for preserving and developing the environment as a national policy decision-maker in order to limit greenhouse gas emissions and to make sustainable Earth through carbon neutrality, indirectly experience a policy making process of a national climate change, and to seek a solution of climate crisis situations, and which can increase fun using feeling of tension and psychology.

Background Art

With global warming, our lives are directly threatened, for instance, extreme weather phenomena, such as intense heat, typhoons, floods, forest fire, and so on, occur frequently, and infections are spreading due to changed ecosystems. So, there are various efforts to lower the level of global warming by reducing greenhouse gas emissions at home and overseas. Korea in 2020 declared achievement of carbon neutrality (Net-zero) by 2050, established 'Carbon Neutrality Committee', is reviewing introduction of various systems, such as a carbon charge system, and is invigorating green investment to support low carbon industries.

Carbon neutrality (Net-zero) refers to a state in which a difference between carbon emission quantity and carbon absorption quantity is zero by reducing the emission quantity caused by use of fossil fuel and increasing use of eco-friendly energies. Recently, because climate change becomes serious as global warming accelerates, Net-zero must be achieved in time in order not to exceed the limit that the earth can endure.

However, it is difficult to perfectly reduce greenhouse gas emissions since energies are used for economic development. So, in order to limit indiscriminate development and reduce greenhouse gas emissions, the international society regulates greenhouse gas emissions through introduction of carbon credit, allows trading of greenhouse gas emissions in relation with the rest and the shortage by setting greenhouse gas target emissions and assessing the actual greenhouse gas emissions according to the Climate Change Convention.

A board game for carbon neutrality education helps a player more easily understand climate crisis situations caused by global warming and complicated policies on carbon neutrality and climate changes in order to solve the climate crisis situations, and indirectly experience national policies on the climate changes and carbon neutrality through a game method that the player as a policy decision-maker decides through negotiations whether to emit more greenhouse gases for economic development or whether to make efforts to lower the level of global warming, copes with the climate crisis situations, and operates policies not to exceed target emissions.

Moreover, if the board game for carbon neutrality education does not have a complicated structure but has a simple structure which makes the game possible just by arithmetic operations, such as addition and subtraction and if the board game provides how to cope with climate change crises in cooperation and competition among players, the board game becomes more useful not only for the entertainment purposes but also for strengthening of educational competency.

In this connection, board games for environmental education on carbon credit have been conventionally used.

However, such conventional board games have several disadvantages in that a player cannot find out other players' states till a game is up, in that any player can never interact with other players in the player's turn even during a card exchanging process, in that it is difficult to form feeling of tension and psychology since the players cannot actually feel the climate change situations caused by carbon emissions, and in that the players get bored and it is difficult to obtain the educational effect on climate change problems.

SUMMARY OF THE INVENTION

Accordingly, the present invention has been made to solve the above-mentioned problems occurring in the prior arts, and it is an object of the present invention to find out the level of global warming during a game, to increase players' feeling of tension and interest by setting climate disaster situations according to increase of the level of global warming, to allow players to interact with other players or check other players while exchanging cards, to increase strategic applicability by adding rules to get scores, and to provide educational effect in relation to the concept of carbon neutrality and solutions for climate change problems.

It is another object of the present invention to provide a board game for carbon neutrality education, which can secure strategies and fun of a game and increase availability in many fields, such as education and public relations.

To accomplish the above object, according to the present invention, there is provided a board game system for carbon neutrality education including: a game display unit including a game board, general cards having carbon cards on which carbon emission quantities are indicated and environment cards on which carbon absorption quantities are indicated, disaster cards on which climate crisis disasters are indicated, convention cards on which rights to change greenhouse gas target amounts are indicated, earth money cards on which scores are indicated, and an indicator for indicating the level of global warming and carbon emission targets; and a game control unit for controlling the game display unit to display the general cards, the disaster cards, the convention cards, the earth money cards, or the indicator on the game board, wherein the game control unit controls the game display unit to display: a carbon emission target indicating part on which a carbon emission target is indicated by the indicator; a global warming level indicating part on which the level of global warming is indicated by the indicator; general card locations on which the general cards before and after the use are arranged; disaster card locations on which the disaster cards before and after the use are arranged; an earth money card location on which the earth money cards are arranged; convention card locations on which the convention cards before and after the use are arranged; and floor card locations on which the general cards submitted by the players are arranged.

According to an embodiment of the present invention, the game control unit provides the earth money card to each player and puts the remaining earth money cards on the earth money card location, arranges the disaster card on the disaster card location, arranges the convention card on the convention card location, arranges the general cards on the general card location, and arranges the general cards arranged on the general card location on the floor card locations one by one.

According to an embodiment of the present invention, when the player selects and turns over the general cards arranged on the floor card locations, the game control unit provides the earth money card to the player who submitted the general cards with the highest number.

According to an embodiment of the present invention, the game control unit determines that when each of the players puts four general cards on the floor card locations and submits the disaster card and the convention card, among the players who have the general cards, arranged on the floor card locations, of which the sum of numbers does not exceed the carbon emission target indicated on the carbon emission target indicating part, the player who has the general cards of which the sum of numbers is the highest becomes a winner. If there are two players having the cards of which the sum of numbers is the highest, the game control unit determines that the player who submitted the card with a higher number among the general cards is a winner, and the game control unit provides the earth money card to the winner.

According to the game control unit, the player who has the general cards, arranged on the floor card locations, of which the sum of numbers exceeds the carbon emission target indicated on the carbon emission target indicating part gives the earth money card to the player who has the general cards of which the sum of numbers is the highest, among the players who have the general cards, arranged on the floor card locations, of which the sum of numbers does not exceed the carbon emission target indicated on the carbon emission target indicating part, or to the player who submitted the general card with the lowest number if there are two players having the cards of which the sum of numbers is the highest.

According to the game control unit, when each of the players puts four general cards on the floor card locations and submits the disaster card and the convention card, the player who has the general cards, arranged on the floor card locations, of which the sum of numbers exceeds the carbon emission target indicated on the carbon emission target indicating part returns one earth money card.

According to an embodiment of the present invention, after the game is over, the game control unit determines that the player who has the most earth money cards is a winner, determines that all players lose if the global warming level indicated on the global warming level indicating part exceeds 4 degrees, determines that the player who has earth money card no more even though the player has to return the earth money card due to the disaster card or excess of the carbon emission target is defeated, or controls other player to submit the earth money card for the player who has no earth money card.

In another aspect of the present invention, provided is a board game method for carbon neutrality education including: a first step of providing general cards arranged on general card locations to players; a second step of arranging the general cards on floor card locations to face down by the players; a third step of providing an earth money card to the player who submitted the general cards with the highest number when turning over the general cards; a fourth step of moving up the global warming level one stage if the sum of the general cards submitted by the players is higher than 0, moving down the global warming level one stage if the sum of the general cards is lower than 0, and not changing the global warming level if the sum of the general cards is 0; a fifth step of indicating the carbon emission target by the indicator when the players select one convention card and change the carbon emission target within a range of a value indicated on the convention card; a sixth step of selecting one disaster card when the global warming level exceeds a predetermined temperature, and receiving the earth money cards from the players according to information indicated on the disaster card; a seventh step of giving or receiving the earth money card according to the sum of the general cards; and an eighth step of determining that the player who has the most earth money cards is a winner.

According to another embodiment of the present invention, the first step to the fifth step, or the first step to the sixth step may be repeated.

According to another embodiment of the present invention, in the seventh step, among the players each of who has submitted four general cards of which the sum of numbers does not exceed the carbon emission target, the player who has the general cards of which the sum of numbers is the highest gets two earth money cards.

According to another embodiment of the present invention, in the seventh step, the player who has submitted four general cards of which the sum of numbers exceeds the carbon emission target returns one earth money card, and among the players each of who has submitted four general cards of which the sum of numbers does not exceed the carbon emission target, the player who has the general cards of which the sum of numbers is the lowest gets the returned earth money card.

According to another embodiment of the present invention, in the seventh step, if the sum of numbers of the general cards 26 and 27 submitted by all players exceeds the carbon emission target, all players return the earth money cards 30.

In a further aspect of the present invention, there is provided a board game for carbon neutrality education including: a game board; general cards having carbon cards on which carbon emission quantities are indicated and environment cards on which carbon absorption quantities are indicated; disaster cards on which climate crisis disasters are indicated; convention cards on which rights to change greenhouse gas target amounts are indicated; earth money cards on which scores are indicated; and an indicator for indicating the level of global warming and carbon emission targets. The game board includes: a carbon emission target indicating part on which a carbon emission target is indicated by the indicator; a global warming level indicating part on which the level of global warming is indicated by the indicator; general card locations on which the general cards before and after the use are arranged; disaster card locations on which the disaster cards before and after the use are arranged; an earth money card location on which the earth money cards are arranged; convention card locations on which the convention cards before and after the use are arranged; and floor card locations on which the general cards submitted by the players are arranged.

Through the board game for carbon neutrality education, and the board game method and board game system for carbon neutrality education according to the present invention, anybody can experience climate change problems during a game, double interest in the game and promote friendship with other players by setting strategies using psychology, for instance, cooperation with other players or check, in order to overcome climate crisis situations and make a sustainable earth, and allow players to naturally understand complicated policies on carbon neutrality and climate change problems.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
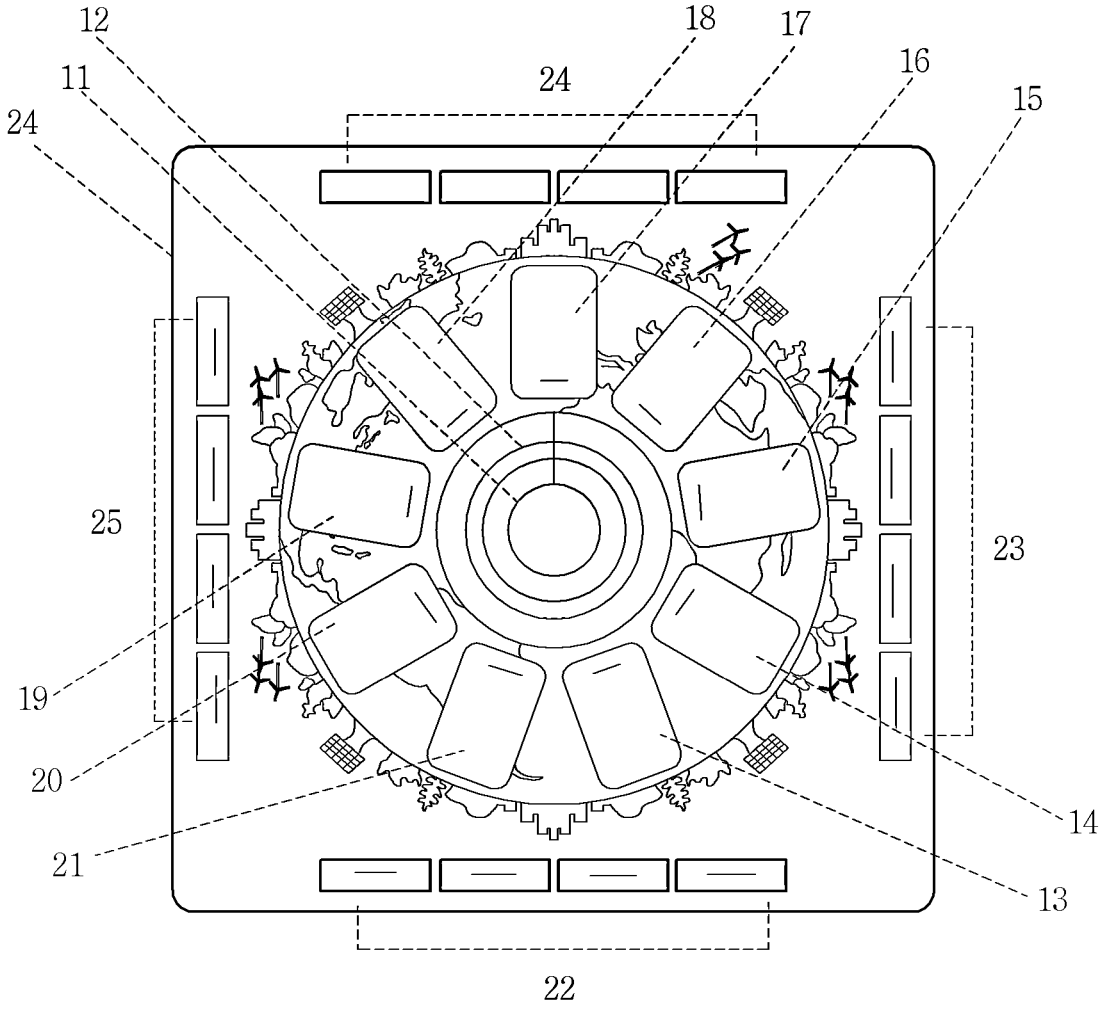
FIGS. 1 to 7 are views illustrating a board game for carbon neutrality education, and a board game method for carbon neutrality education according to an embodiment of the present invention.

Hereinafter, preferred embodiments of the present invention will be described in detail with reference to the accompanying drawings. However, in a case where it is determined that detailed description of well-known features and configurations according to the present disclosure and all other matters unnecessarily obscure the gist of the present disclosure, the detailed description will be omitted. Moreover, in the drawings, sizes of components may be exaggerated for clarity and convenience in explanation, and do not mean the sizes applied actually.

Figure 2:
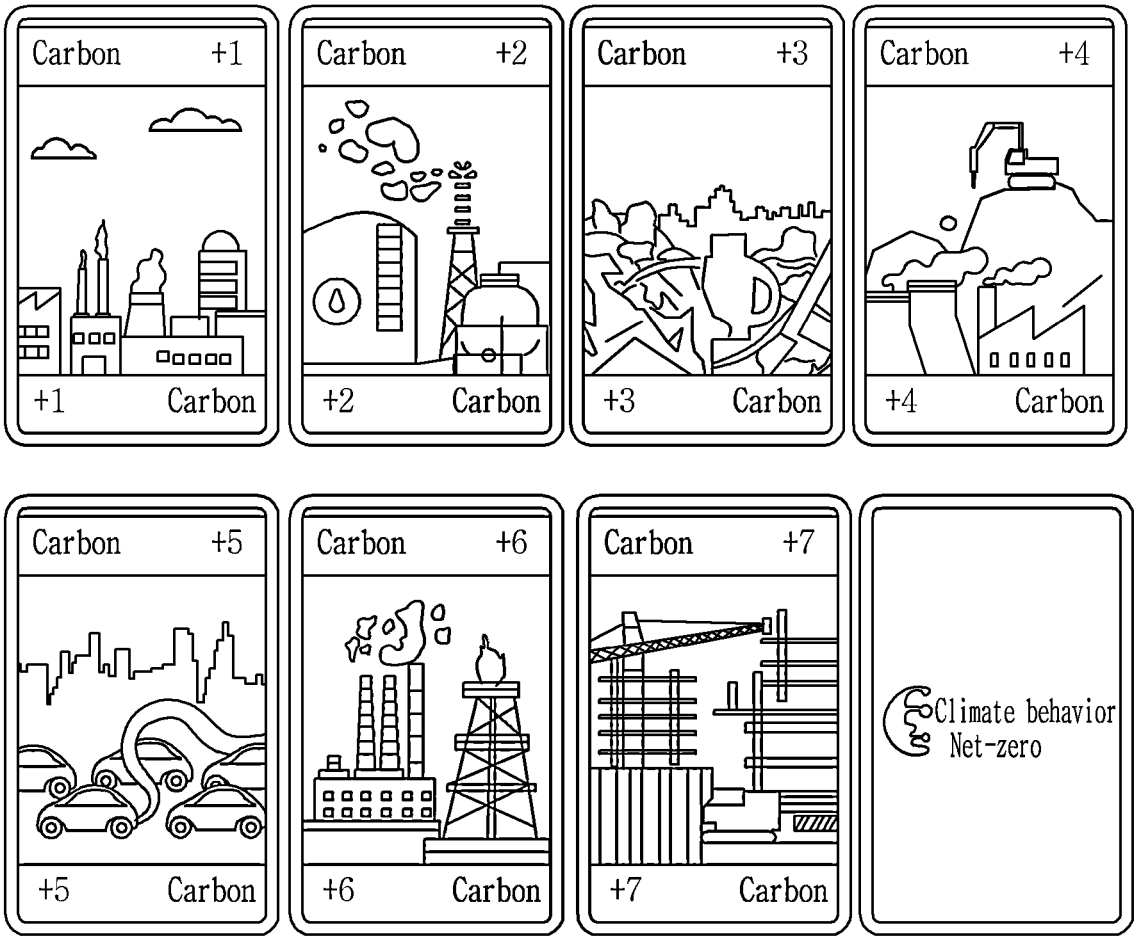
Figure 3:
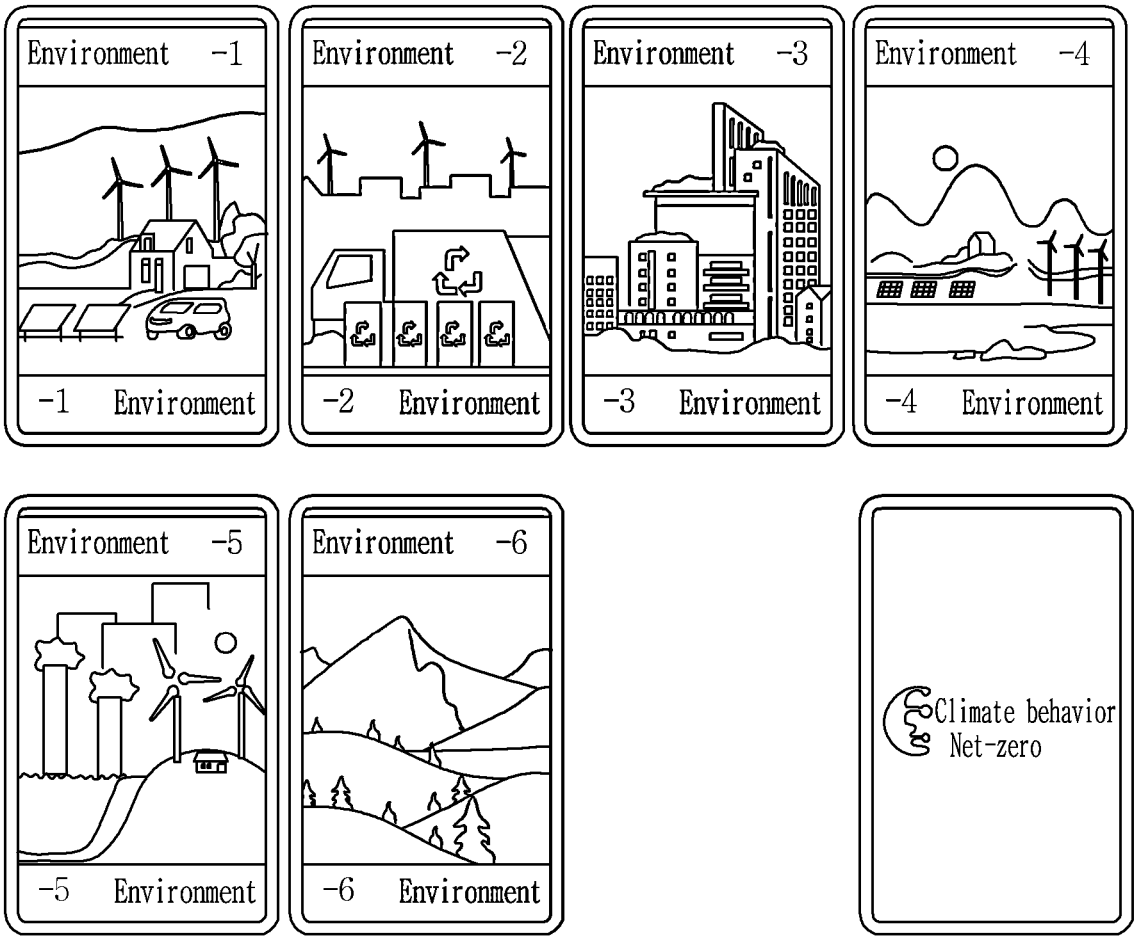
Figure 4:
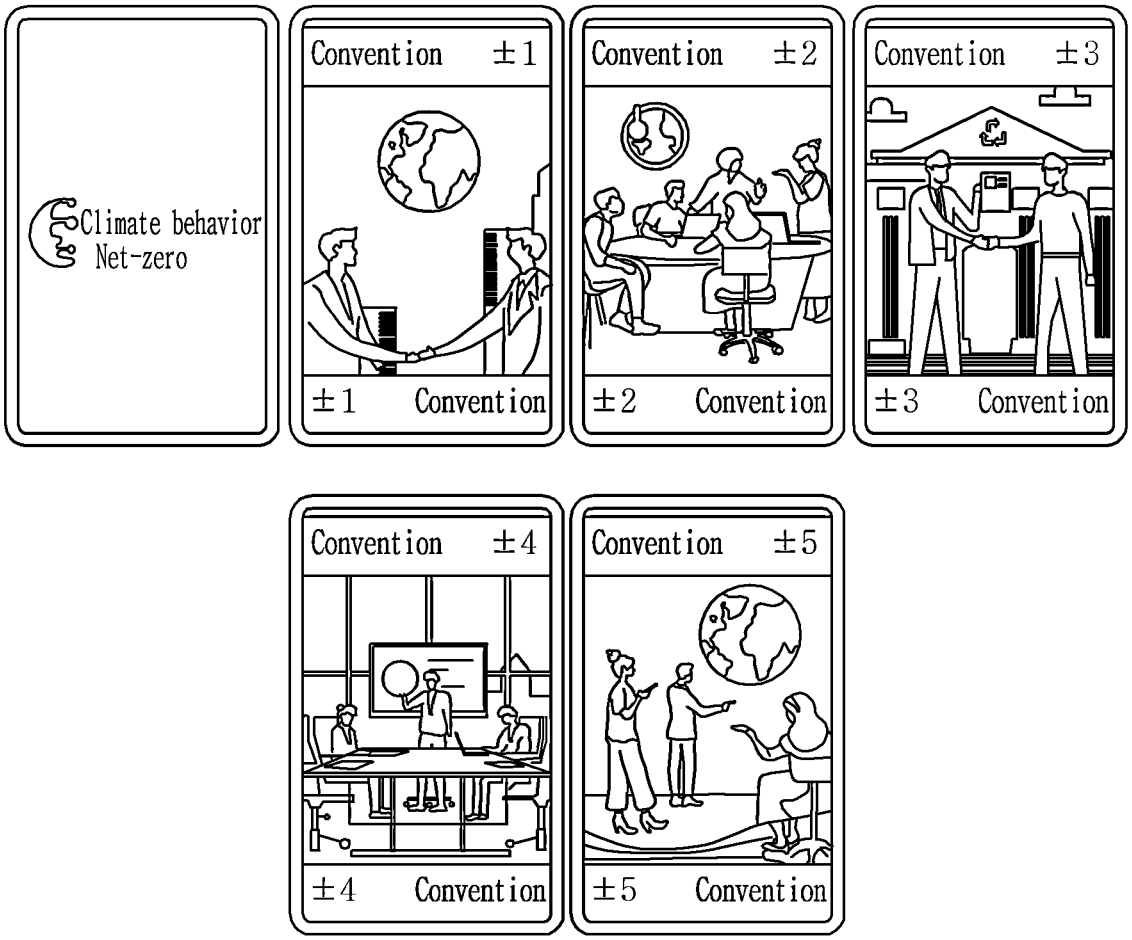
Figure 5:
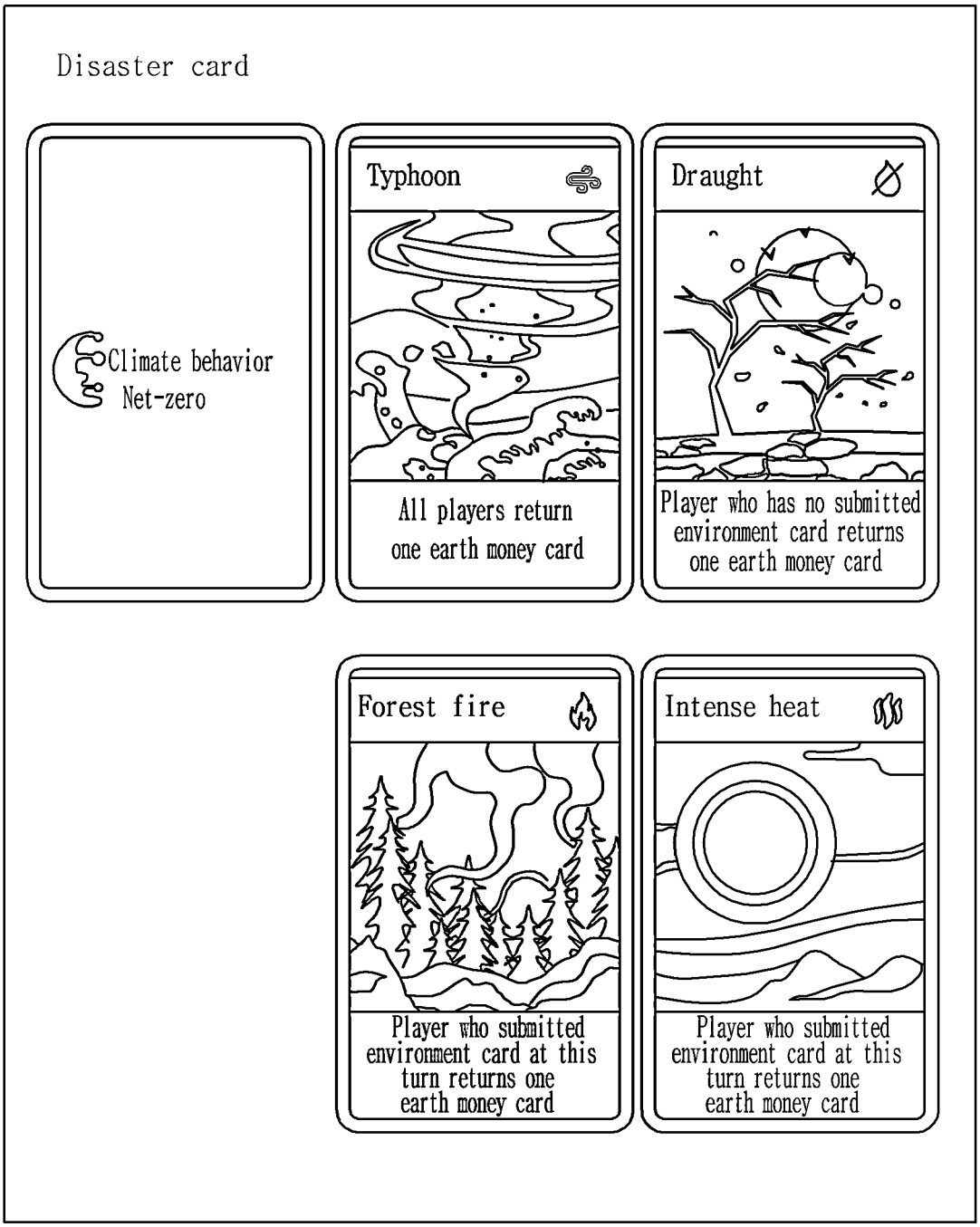
Figure 6:
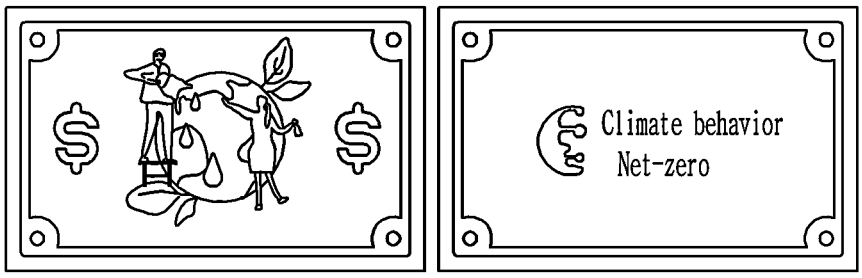
Figure 7:
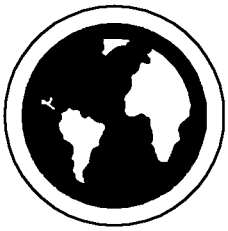

FIGS. 1 to 7 are views illustrating a board game for carbon neutrality education, and a board game method for carbon neutrality education according to an embodiment of the present invention. In more detail, FIG. 1 illustrates a board game for carbon neutrality education according to an embodiment of the present invention, FIG. 2 illustrates general cards (carbon cards) on which carbon emission quantities are indicated, FIG. 3 illustrates general cards (environment cards) on which carbon absorption quantities are indicated, FIG. 4 illustrates convention cards according to an embodiment of the present invention, FIG. 5 illustrates disaster cards according to an embodiment of the present invention, FIG. 6 illustrates earth money cards according to an embodiment of the present invention, and FIG. 7 illustrates an indicator according to an embodiment of the present invention.

Hereinafter, referring to FIGS. 1 to 7, a board game for carbon neutrality education, and a board game method for carbon neutrality education according to the embodiment of the present invention will be described.

The board game for carbon neutrality education according to an embodiment of the present invention includes: a game board 10, general cards 26 and 27 having carbon cards 26 on which carbon emission quantities are indicated and environment cards 27 on which carbon absorption quantities are indicated, disaster cards 28 on which climate crisis disasters are indicated, convention cards 29 on which rights to change greenhouse gas target amounts are indicated, earth money cards 30 on which scores are indicated, and an indicator 31 for indicating the level of global warming and carbon emission targets.

There are eight sets of seven carbon cards 26 on which +1 to +7 are respectively indicated, namely, total 56 carbon cards. There are four sets of six environment cards 27 on which −1 to −6 are respectively indicated, namely, total 24 environment cards.

Furthermore, there are total five convention cards 29 on which +/−1 to +/−5 are respectively indicated, and the disaster cards 28 are two sets of a typhoon card, a drought card, a forest fire card, and an intense heat card. In this instance, in the case of the typhoon card, all players have to return one earth money card. In the case of the drought card, a player who has no environment card submitted has to return one earth money card, in the case of the forest fire card, a player who submitted the environment card at the corresponding turn has to return one earth money card, and in the case of the intense heat card, a player who submitted the carbon card at the corresponding turn has to return one earth money card.

Additionally, there are total 30 earth money cards 30 and two indicators 31.

The indicators 31 are arranged on the game board 10. The game board 10 includes a carbon emission target indicating part 11 on which a carbon emission target is indicated by the indicator 31, a global warming level indicating part 12 on which the level of global warming is indicated by the indicator 31, general card locations 13 and 14 on which the general cards before and after the use are arranged, disaster card locations 15, 16, 17 and 18 on which the disaster cards before and after the use are arranged, an earth money card location 19 on which the earth money cards are arranged, convention card locations 20 and 21 on which the convention cards before and after the use are arranged, and floor card locations 22, 23, 24 and 25 on which the general cards submitted by the players are arranged.

First, each of the players gets three of the earth money cards 30, and then, the remaining earth money cards 30 are put on the earth money card location 19. A game host mixes the disaster cards well, and then, puts the disaster cards on the disaster card location 15 (before the use) face down. After that, the game host mixes the convention cards 29 well, and then, puts the convention cards 29 on the convention card location 20 (before the use) face down. After that, the game host mixes the general cards (carbon/environment) 26 and 27 well, and then, puts the general cards on the general card location 13 (before the use) face down. After that, the game host pulls out four cards at random and provides each player with the cards face down. Each player has the received general cards 26 and 27 in hand not to show other players. When a first round starts, the game host puts the indicator 31 to set the carbon emission target 11 to be in a range from 10 to 15 and to set the global warming level at one degree. Then, the players are ready to start a game.

The game host can set the game order in various ways, for instance, may proceed the game in the clockwise direction or in the counterclockwise direction. After that, in the next round, the player who won the previous round starts the game. If there is no winner in the previous round, the game goes on in the same order as the previous round. The game host explains target emission quantity and global warming level of the corresponding round to the players. A limit criteria of greenhouse gas emissions in the corresponding round may be changed through convention cards during the game, and the global warming level may be changed at every turn according to the sum of the general cards 26 and 27 submitted by the players.

In addition, one round has four turns, and a game has total four rounds. At each turn, each of the players puts one among the general cards 26 and 27 in hand on the floor card locations 22, 23, 24 and 25 face down, and then, all players turn the submitted cards over to check after all players submitted the cards. The game host gives one earth money card 30 to the player who submitted the carbon card 26 with the highest number.

At each round, when the round ends after all players submitted the four cards on the floor card locations 22, 23, 24 and 25 and the convention cards 29 and the disaster cards 28 were completely carried out, the player who has the highest sum of the numbers of the general cards 26 and 27, among the players who has the sum of the general cards 26 and 27 put on the floor card locations 22, 23, 24 and 25 does not exceed the carbon emission target of the corresponding round, is a winner. In this instance, if there are two players having the highest number, the player who has the card with a higher number among the general cards put on the floor card location is a winner. The game host gives two earth money cards 30 to the winner. When the corresponding round is ended, the player who has the general cards 26 and 27 which are put on the floor card locations 22, 23, 24 and 25 and of which the sum of numbers exceeds the carbon emission target loses one earth money card 30 to the player who has the general cards 26 and 27 which are put on the floor card locations 22, 23, 24 and 25 and of which the sum of numbers is the lowest, among the players who have the cards which do not exceed the carbon emission target. In this instance, if there are two players who have the general cards of which the sum of numbers is the lowest, the player who has the general cards 26 and 27 of which the sum of numbers exceeds the carbon emission target loses one earth money card 30 to the player who has the card with a lower number among the general cards 26 and 27 put on the floor card location. If all players exceed the carbon emission limit criterion when the corresponding round is over, each of the players must submit one earth money card 30 to the game host.

The player who has the largest number of the earth money cards 30 when the four rounds are over is the winner. However, if the global warming level is over four degrees when each round is over, the game host declares all players are losers and the game is over. Moreover, the player who cannot return the earth money card 30 due to the charge of the disaster card 28 or the charge caused by excess of the carbon emission target becomes a loser. However, in the case that the player cannot pay the corresponding cost, other player may return the earth money for the player who cannot pay, but it is not compulsory.

FIGS. 8 to 12 are flow charts illustrating the board game method for carbon neutrality education according to an embodiment of the present invention.

Hereinafter, referring to FIGS. 8 to 12, a board game method for carbon neutrality education according to the embodiment of the present invention will be described.

The board game method for carbon neutrality education according to the embodiment of the present invention may be provided using a board game system for carbon neutrality education.

Figure 8:
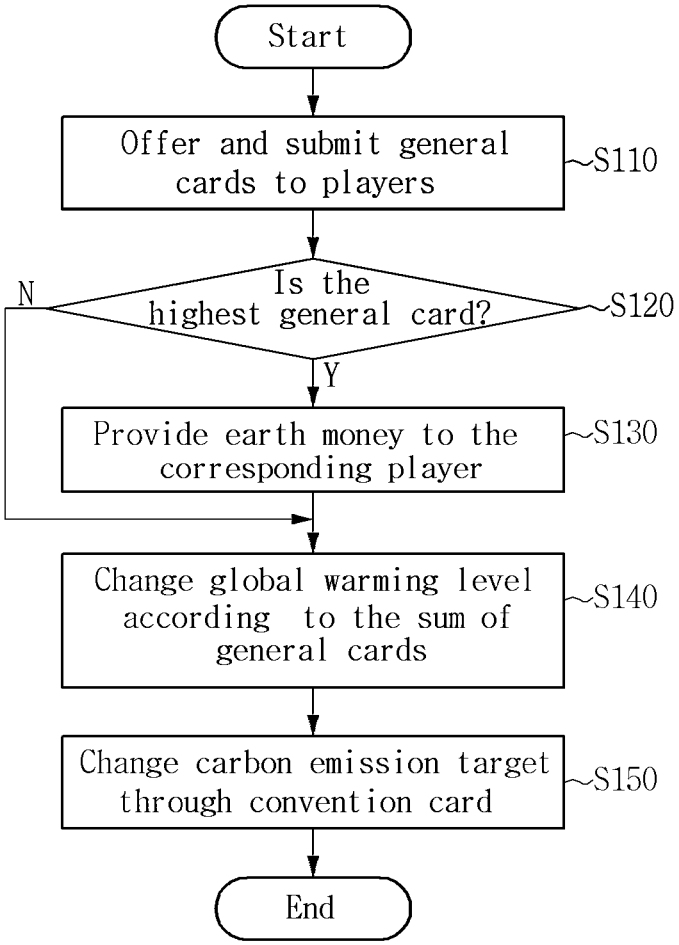
FIGS. 8 to 12 are flow charts illustrating the board game method for carbon neutrality education according to an embodiment of the present invention.

First, referring to FIG. 8, a player receives one general card 26 or 27 from the general card location 13 (before the use) when it is the player's turn according to the game routine. The player selects one general card 26 or 27, puts it on the floor card location 22 (first turn card) face down not to show the number.

After that, in the same way, all players put their own general cards 26 and 27 on the floor card locations 22, 23, 24 and 25 (first turn cards), and then, turn over the general cards together to open the cards (S110). In the corresponding turn, the player who submitted the general card with the highest number gets one earth money card 30 from each of the rest players (S120 and S130).

After that, when the first turn is over, if the sum of the carbon card 26 and the environment card 27 submitted by the players is higher than 0, the global warming level 12 goes up one notch. If the sum of the carbon card 26 and the environment card 27 submitted by the players is lower than 0, the global warming level 12 goes down one notch. In this instance, a scale between notches may be set in 0.25, 0.5, or 1 degree.

If the sum of the general cards 26 and 27 submitted in the corresponding turn is 0, the global warming level is not changed. The game host indicates the current global warming level using the indicator 31 and informs the users of the changed point (S140).

When the first turn is over and the change of the global warming level is finished, the game host turns over the uppermost convention card 29 put on the convention card location (before the use) to check the number. After that, the player may increase or decrease the carbon emission target 11 of the corresponding turn through the convention card 29, but in this instance, the players can negotiate it by a majority vote. If a decision is not made, the player who has the priority in order decides the carbon emission target. According to the decided sign, the carbon emission target for the corresponding turn is changed (S150). For instance, if the players decide the convention card with the number of '+/−3' as a minus sign, in the case that the current greenhouse gas carbon emission target is 15, the carbon emission target becomes 12 since 3 is subtracted from the limit criterion. Furthermore, the game host indicates the carbon emission target using the indicator 31, and then, informs the players of the changed point.

Figure 9:
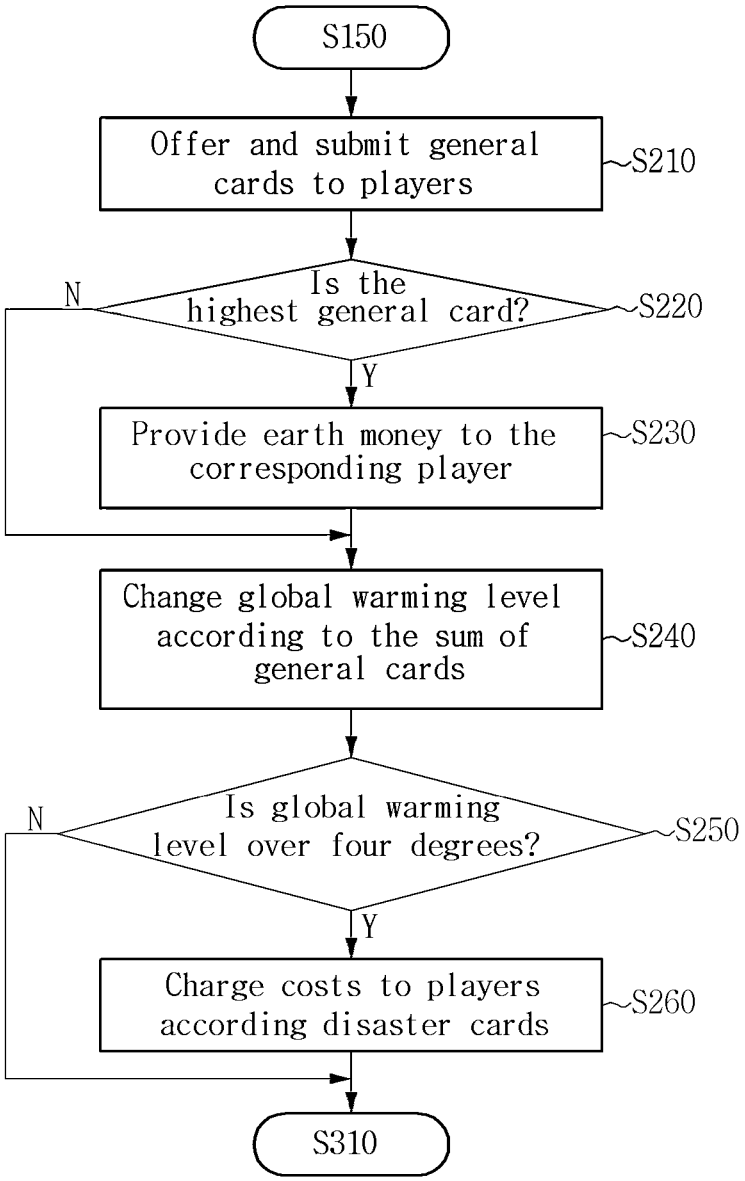

Referring to FIG. 9, in the same order as the game method illustrated in FIG. 8, a player receives one general card 26 or 27 from the general card location 13 (before the use) when it is the player's turn according to the game routine. The player selects one general card 26 or 27, puts it on the floor card location 22 (second turn card) face down not to show the number.

After that, in the same way, all players put their own general cards 26 and 27 on the floor card locations 22, 23, 24 and 25 (second turn cards), and then, turn over the general cards together to open the cards (S210). In the corresponding turn, the player who submitted the carbon card 26 with the highest number gets one earth money card 30 from each of the rest players (S220 and S230).

After that, when the second turn is over, if the sum of the carbon card 26 and the environment card 27 submitted by the players is higher than 0, the global warming level 12 goes up one notch. If the sum of the carbon card 26 and the environment card 27 submitted by the players is lower than 0, the global warming level 12 goes down one notch. If the sum of the general cards 26 and 27 submitted in the corresponding turn is 0, the global warming level is not changed. The game host indicates the current global warming level using the indicator 31 and informs the users of the changed point (S240).

After that, if the global warming level is over four degrees when the second round is over, the game host turns over one disaster card 28 and puts it on the disaster card location 16 (second turn), and then, charges the players damage costs according to the corresponding command (S260). For instance, in the case of the typhoon card, all players have to return one earth money card. In the case of the drought card, a player who has no environment card submitted has to return one earth money card, in the case of the forest fire card, a player who submitted the environment card at the corresponding turn has to return one earth money card, and in the case of the intense heat card, a player who submitted the carbon card at the corresponding turn has to return one earth money card.

Figure 10:
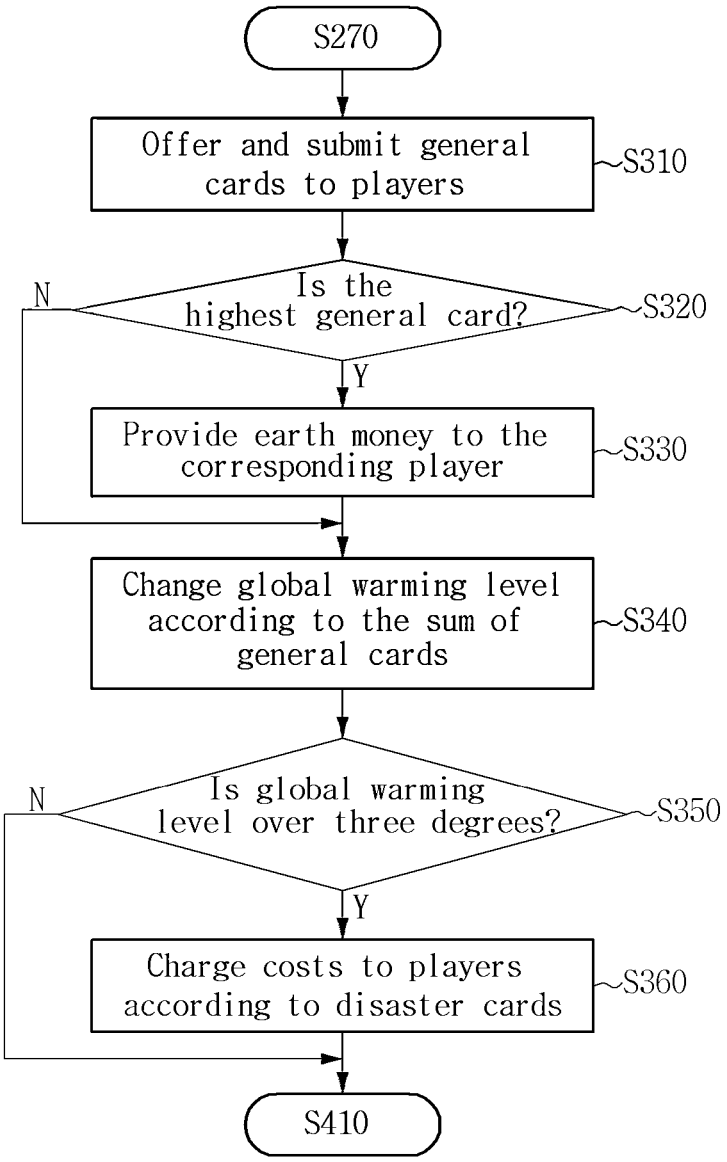

After that, referring to FIG. 10, in the same order, a player receives one general card 26 or 27 from the general card location 13 (before the use) when it is the player's turn according to the game routine. The player selects one general card 26 or 27, puts it on the floor card location 22 (third turn card) face down not to show the number.

After that, in the same way, all players put their own general cards 26 and 27 on the floor card locations 22, 23, 24 and 25 (third turn cards), and then, turn over the general cards together to open the cards (S310). In the corresponding turn, the player who submitted the carbon card 26 with the highest number gets one earth money card 30 from each of the rest players (S320 and S330).

After that, when the third turn is over, if the sum of the carbon card 26 and the environment card 27 submitted by the players is higher than 0, the global warming level 12 goes up one notch. If the sum of the carbon card 26 and the environment card 27 submitted by the players is lower than 0, the global warming level 12 goes down one notch. If the sum of the general cards 26 and 27 submitted in the corresponding turn is 0, the global warming level is not changed. The game host indicates the current global warming level using the indicator 31 and informs the users of the changed point (S340).

After that, if the global warming level is over three degrees, the game host turns over one disaster card 28 and puts it on the disaster card location 17 (third turn), and then, charges the players damage costs according to the corresponding command (S360). For instance, in the case of the typhoon card, all players have to return one earth money card. In the case of the drought card, a player who has no environment card submitted has to return one earth money card, in the case of the forest fire card, a player who submitted the environment card at the corresponding turn has to return one earth money card, and in the case of the intense heat card, a player who submitted the carbon card at the corresponding turn has to return one earth money card.

Figure 11:
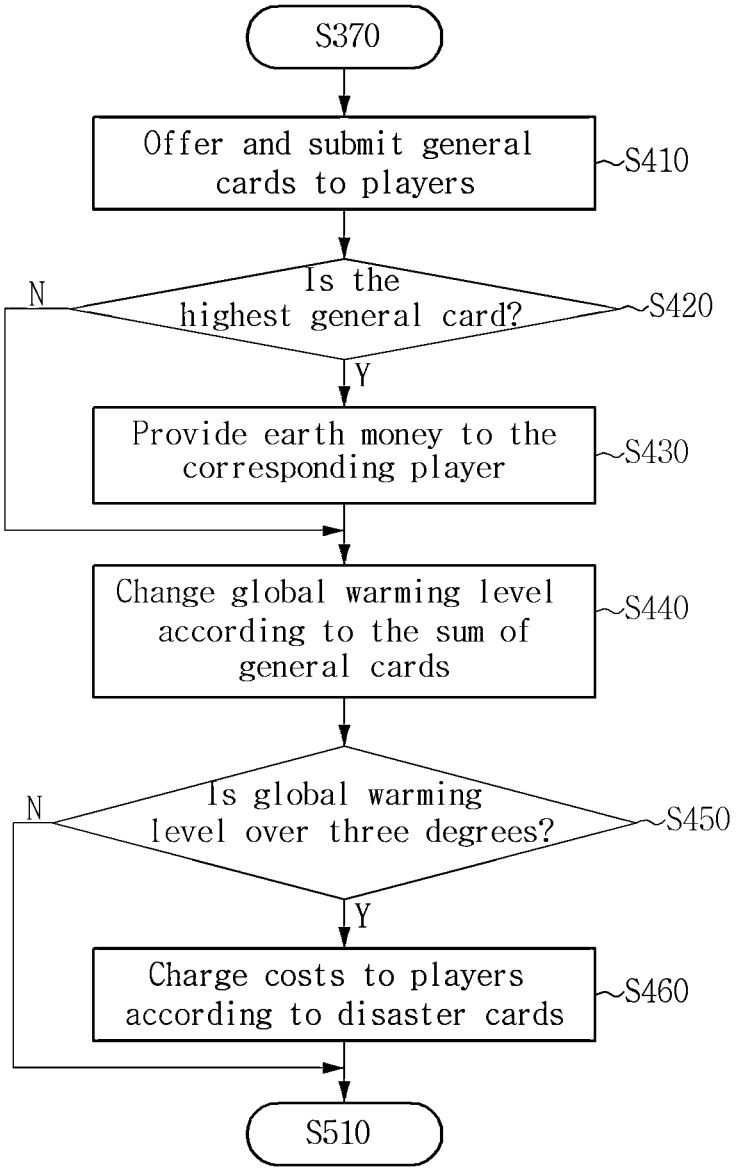

After that, referring to FIG. 11, in the same order, a player receives one general card 26 or 27 from the general card location 13 (before the use) when it is the player's turn according to the game routine. The player selects one general card 26 or 27, puts it on the floor card location 22 (fourth turn card) face down not to show the number.

After that, in the same way, all players put their own general cards 26 and 27 on the floor card locations 22, 23, 24 and 25 (fourth turn cards), and then, turn over the general cards together to open the cards (S410). In the corresponding turn, the player who submitted the carbon card 26 with the highest number gets one earth money card 30 from each of the rest players (S420 and S430).

After that, when the fourth turn is over, if the sum of the carbon card 26 and the environment card 27 submitted by the players is higher than 0, the global warming level 12 goes up one notch. If the sum of the carbon card 26 and the environment card 27 submitted by the players is lower than 0, the global warming level 12 goes down one notch. If the sum of the general cards 26 and 27 submitted in the corresponding turn is 0, the global warming level is not changed. The game host indicates the current global warming level using the indicator 31 and informs the users of the changed point (S440).

After that, if the global warming level is over two degrees, the game host turns over one disaster card 28 and puts it on the disaster card location 18 (fourth turn), and then, charges the players damage costs according to the corresponding command (S460). For instance, in the case of the typhoon card, all players have to return one earth money card. In the case of the drought card, a player who has no environment card submitted has to return one earth money card, in the case of the forest fire card, a player who submitted the environment card at the corresponding turn has to return one earth money card, and in the case of the intense heat card, a player who submitted the carbon card at the corresponding turn has to return one earth money card.

According to the above procedures, when all of the four turns are over, the game of the corresponding round is terminated.

Figure 12:
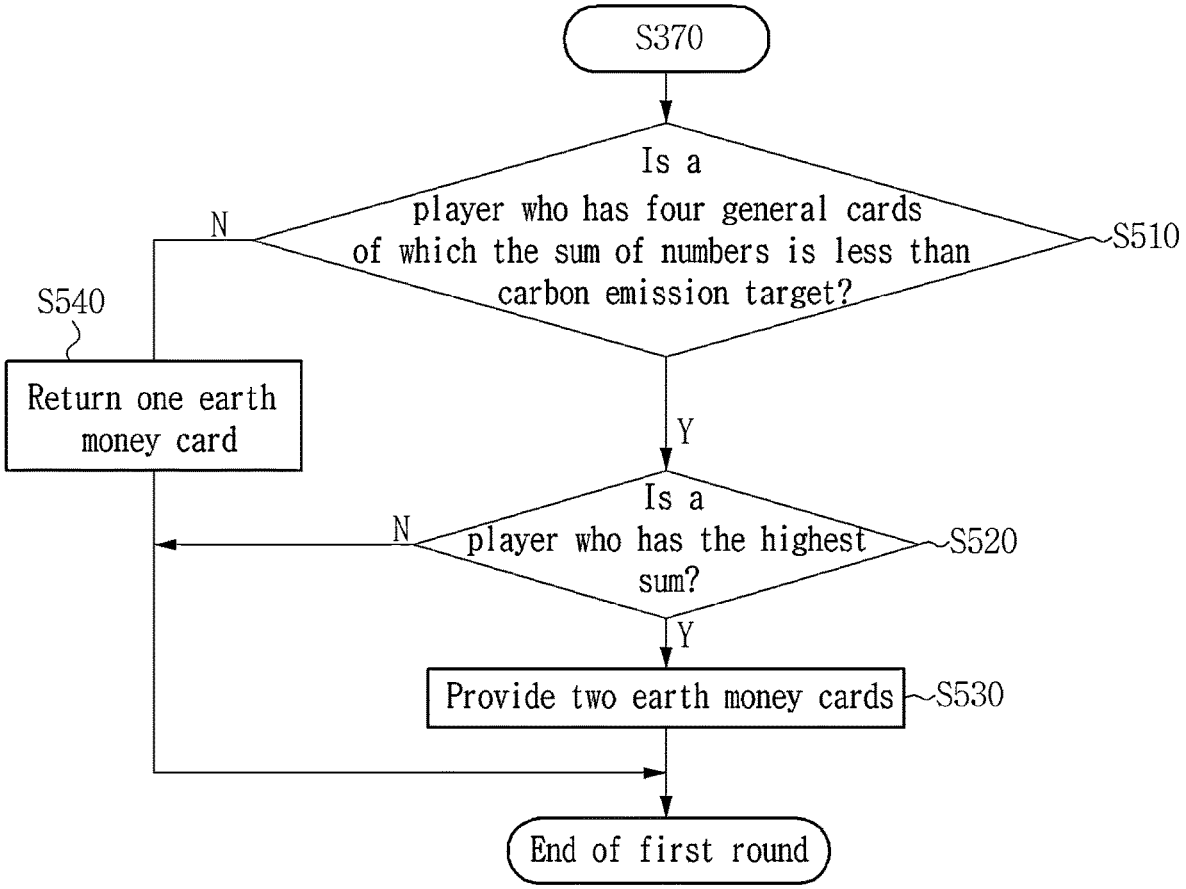

Referring to FIG. 12, the player who has the highest sum, among the players who has four submitted general cards 26 and 27 of which the sum of numbers does not exceed the carbon emission target 11 of the corresponding round (S510), gets two earth money cards 30 (S520 and S530).

If there is a player who has four submitted cards of which the sum of numbers exceeds the carbon emission target 11, the player returns one earth money card 30, and the player who has the lowest sum, among the players who do not exceed the carbon emission target 11, gets the returned earth money card 30. If all players exceed the carbon emission target 11, the game host gets one earth money card 30 from each player (S540).

Furthermore, the game host collects all of the general cards, which were used in the corresponding round, from the floor card locations, and then, puts them on the general card location (after the use).

As described above, when the settlement of the corresponding round is finished, the next round starts. That is, the game method from FIG. 8 to FIG. 12 is repeated. In this instance, the carbon emission target and the global warming level maintain the same numerical values as the previous round. Total four rounds are carried out, and then, the player who obtains the most earth money cards 30 is the final winner.

Figure 13:
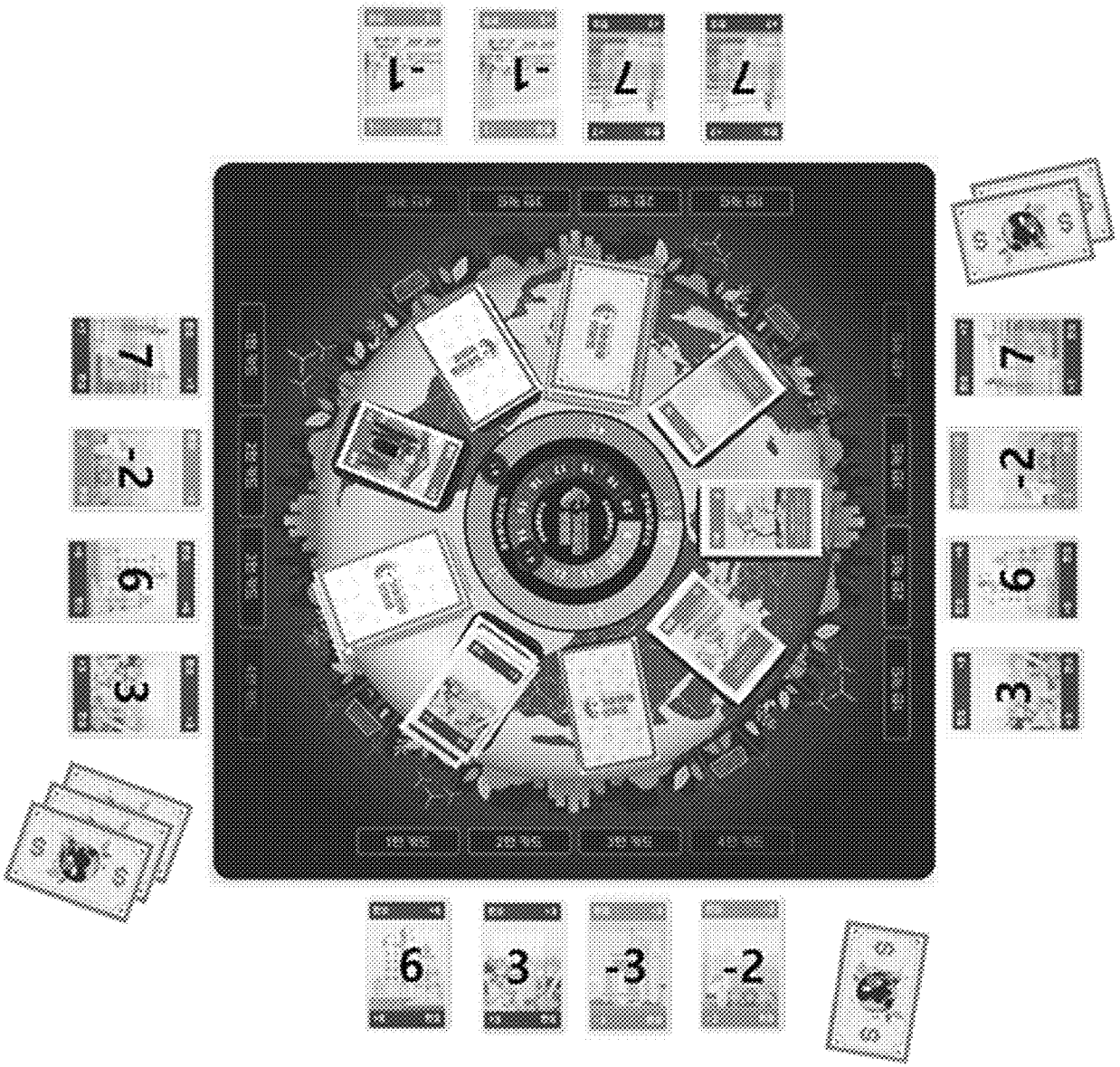
FIG. 13 illustrates a method of determining the final winner by the board game method for carbon neutrality education according to the embodiment of the present invention.

FIG. 13 illustrates a method of determining the final winner by the board game method for carbon neutrality education according to the embodiment of the present invention.

In more detail, FIG. 13 illustrates a game rule when the final round is finished in the board game method for carbon neutrality education according to the embodiment of the present invention, wherein up to now, the carbon emission target is 13, and the global warming level is 3 degrees.

The lower player (first player) has the floor cards of which the sum of numbers is 14, the left player (second player) has the floor cards of which the sum is 12, the upper player (third player) has the floor cards of which the sum is 14, and the right player (fourth player) has the floor cards of which the sum is 4.

In this case, because the first and third players exceed the carbon emission target, the winner is the second player, and the second player gets two earth money cards 30 from the game host.

The first player and the third player lose one earth money card 30 of each to the fourth player.

When the settlement in the final round is finished, because the first player gets two earth money cards, the second player gets wo earth money cards, the third player gets one earth money card, and the fourth player gets three earth money cards, the fourth player becomes the final winner.

As described above, using the board game method for carbon neutrality education according to the present invention, players can cooperate with other players and plan sustainable development in consideration of the current global warming level, and an increase of carbon emissions due to indiscriminate development causes climate disasters and causes defeat of all people at worst. Therefore, players can win a victory using psychology, for instance, hide their strategies, cooperate with other players or hold other players in check while confirming the global warming level, and predict and decide their own cards and changes in situation till the game is over.

Additionally, when the corresponding round is terminated, because not only a player who has the highest carbon emission quantity but also a player who has a lower carbon emission quantity but made efforts to suppress the global warming level can obtain scores and a player who increased the carbon emission quantity thoughtlessly has a penalty, namely, because there are chances to get scores in various ways, the players can feel fun using tension and psychology to the end.

In addition, the players can easily determine the global warming level and climate disaster conditions, and easily check the current situations and scores since coin cards are added so as to easily decide the final winner.

Figure 14:
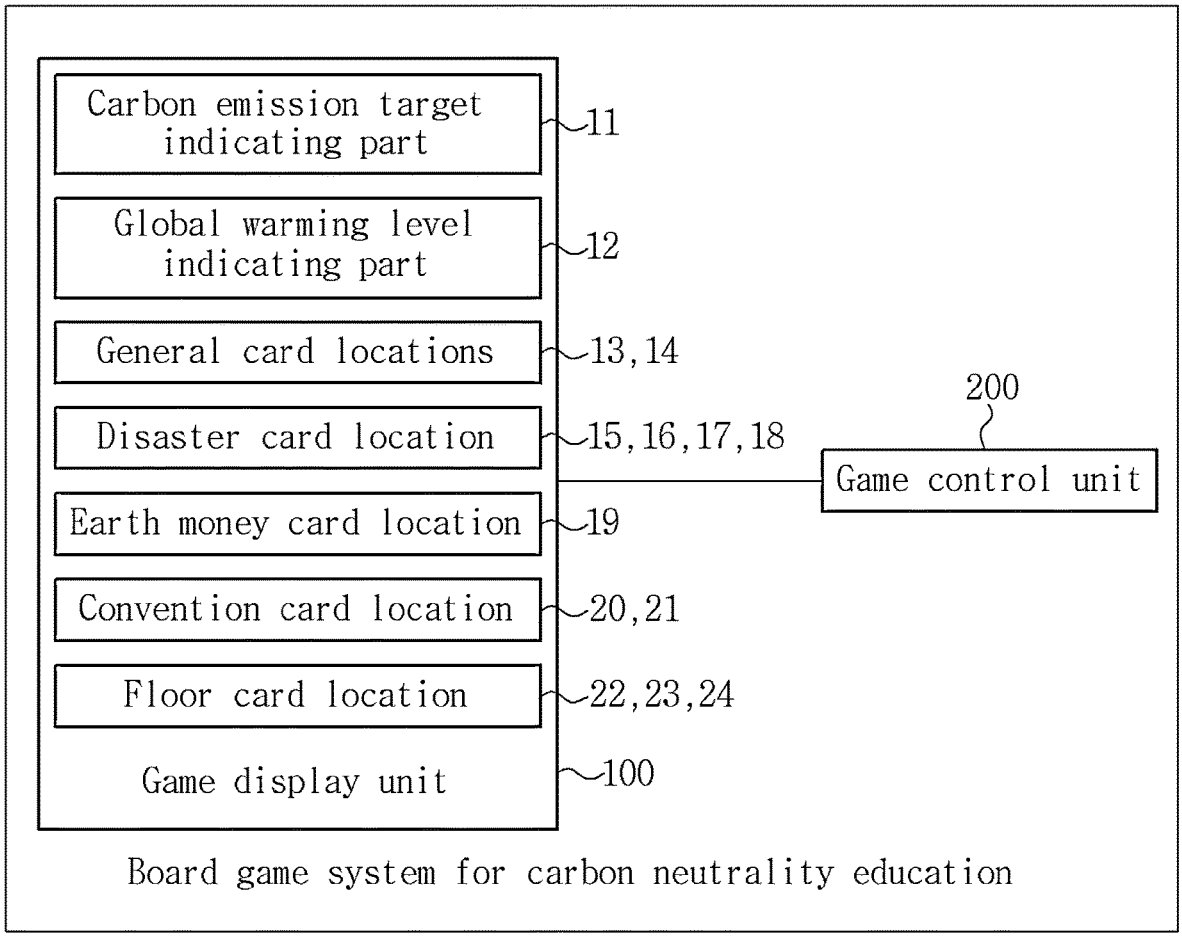
FIG. 14 is a view of the configuration of a board game system for carbon neutrality education according to an embodiment of the present invention.

FIG. 14 is a view of the configuration of a board game system for carbon neutrality education according to an embodiment of the present invention.

Hereinafter, referring to FIG. 14, the configuration of a board game system for carbon neutrality education according to an embodiment of the present invention will be described.

The board game system for carbon neutrality education according to the embodiment of the present invention includes a game display unit 100 and a game control unit 200.

The game display unit 100 includes a game board 10, general cards 26 and 27 having carbon cards 26 on which carbon emission quantities are indicated and environment cards 27 on which carbon absorption quantities are indicated, disaster cards 28 on which climate crisis disasters are indicated, convention cards 29 on which rights to change greenhouse gas target amounts are indicated, earth money cards 30 on which scores are indicated, and an indicator 31 for indicating the level of global warming and carbon emission targets.

The game control unit 200 controls the game display unit 100 to display the general cards 26 and 27, the disaster cards 28, the convention cards 29, the earth money cards 30, or the indicator 30 on the game board 10.

In this instance, the game control unit 200 controls the game display unit 100 to display a carbon emission target indicating part 11, a global warming level indicating part 12, general card locations 13 and 14, disaster card locations 15, 16, and 18, an earth money card location 19, convention card locations 20 and 21, and floor card locations 22, 23, 24 and 25 on the game board 10 displayed through the game display unit 100.

Moreover, the carbon emission target indicating part indicates a carbon emission target by the indicator 31 arranged thereon, the global warming level indicating part 12 indicates the global warming level by the indicator 31 arranged thereon, the general cards 26 and 27 before and after the use are arranged on the general card locations 13 and 14, the earth money card 30 is arranged on the earth money card location 19, the convention cards 29 before and after the use are arranged on the convention card locations 20 and 21, and the general cards 26 and 27 which are submitted by the players are arranged on the floor card locations 22, 23, 24 and 25.

Furthermore, the game control unit 200 provides the earth money card 30 to each player and puts the remaining earth money cards 30 on the earth money card location 19, arranges the disaster card 28 on the disaster card location 15, arranges the convention card 29 on the convention card location 20, arranges the general cards 26 and 27 on the general card location 13, and arranges the general cards 26 and 27 arranged on the general card location 13 on the floor card locations 22, 23, 24 and 25 one by one.

Additionally, when the player selects and turns over the general cards 26 and 27 arranged on the floor card locations 22, 23, 24 and 25, the game control unit 200 provides the earth money card 30 to the player who submitted the general cards 26 and 27 with the highest number.

In addition, according to the game control unit 200, when each of the players puts four general cards 26 and 27 on the floor card locations 22, 23, 24 and 25 and submits the disaster card 28 and the convention card 29, among the players who have the general cards, arranged on the floor card locations 22, 23, 24 and 25, of which the sum of numbers does not exceed the carbon emission target indicated on the carbon emission target indicating part 11, the player who has the general cards 26 and 27 of which the sum of numbers is the highest, becomes a winner.

Moreover, if there are two players having the cards of which the sum of numbers is the highest number, the game control unit 200 determines that the player who submitted the card with a higher number among the general cards 26 and 27 is a winner, and provides the earth money card 30 to the winner.

Furthermore, according to the game control unit 200, the player who has the general cards 26 and 27, arranged on the floor card locations 22, 23, 24 and 25, of which the sum of numbers exceeds the carbon emission target indicated on the carbon emission target indicating part 11 gives the earth money card 30 to the player who has the general cards 26 and 27 of which the sum of numbers is the highest, among the players who have the general cards, arranged on the floor card locations 22, 23, 24 and 25, of which the sum of numbers does not exceed the carbon emission target indicated on the carbon emission target indicating part 11, or to the player who submitted the general card with the lowest number if there are two players having the cards of which the sum of numbers is the highest number.

Additionally, according to the game control unit 200, when each of the players puts four general cards 26 and 27 on the floor card locations 22, 23, 24 and 25 and submits the disaster card 28 and the convention card 29, the player who has the general cards, arranged on the floor card locations 22, 23, 24 and 25, of which the sum of numbers exceeds the carbon emission target indicated on the carbon emission target indicating part 11 returns one earth money card 30.

In addition, after the game, the game control unit 200 determines that the player who has the most earth money cards 30 is a winner, determines that all players lose if the global warming level indicated on the global warming level indicating part 12 exceeds 4 degrees, determines that the player who has earth money card 30 no more even though the player has to return the earth money card due to the disaster card 28 or excess of the carbon emission target is defeated, or may control other player to submit the earth money card 30 for the player who has no earth money card.

As described above, while the present invention has been particularly shown and described with reference to the example embodiments thereof, it will be understood by those of ordinary skill in the art that various changes, modifications and equivalents may be made in the present invention without departing from the technical scope and idea of the present invention. Therefore, it would be understood that the present invention is not limited to the embodiments of the present invention, and the present invention covers all such modifications provided they come within the scope of the appended claims and their equivalents.

What is claimed is:

1. A board game for carbon neutrality education comprising:

a game display including a game board, general cards having carbon cards on which carbon emission quantities are indicated and environment cards on which carbon absorption quantities are indicated, disaster cards on which climate crisis disasters are indicated, convention cards on which rights to change greenhouse gas target amounts are indicated, and earth money cards on which scores are indicated;

a first indicator part which is movable on the game board; and a second indicator part which is movable on the game board;

wherein the game board comprises:

a carbon emission target indicating part including first sections respectively corresponding to values of a carbon emission target, wherein a current value of the carbon emission target is indicated by a movement of the first indicator part with respect to one or more of the first sections;

a global warming level indicating part including second sections respectively corresponding to values of a global warming level expressed in degrees, wherein a current value of the global warming level is indicated by a movement of the second indicator part with respect to one or more of the second sections;

general card locations comprising a first general card location on which the general cards are arranged before use and a second general card location on which the general cards are arranged after use;

disaster card locations comprising a first disaster card location on which the disaster cards are arranged before use and a second disaster card location on which the disaster cards are arranged after use;

an earth money card location on which the earth money cards are arranged before use;

convention card locations comprising a first convention card location on which the convention cards are arranged before use and a second convention card location on which the convention cards are arranged after use; and floor card locations on which general cards respectively submitted by and turned over by players during respective player turns are arranged, wherein the floor card locations are respectively associated with the players, wherein:

the second indicator part is placed with respect to one or more of the second sections of the global warming level indicating part to indicate an increase in the global warming level, no change in the global warming level, or a decrease in the global warming level, based on a sum of values associated with the general cards respectively submitted and turned over in the floor card locations, and the first indicator part is placed with respect to one or more of the first sections of the carbon emission target indicating part to indicate an increase in the carbon emission target, no change in the carbon emission target, or a decrease in the carbon emission target, based on a value of a convention card which is turned over from among the convention cards.

2. The board game according to claim 1, wherein game rules of the board game specify that an earth money card from among the earth money cards is to be provided to a player who turned over a general card having a highest number from among the general cards respectively submitted and turned over in the floor card locations.

3. The board game according to claim 2, wherein the game rules specify that, among a submitted disaster card, a submitted convention card, and sets of four general cards respectively submitted and turned over by the players from among the players, the set of four general cards having a sum of numbers which does not exceed the carbon emission target indicated on the carbon emission target indicating part and which is highest among the sets of four general cards is a winning set of four general cards, wherein for a case in which at least two sets of four general cards are submitted and turned over and each have a sum of numbers which does not exceed the carbon emission target indicated on the carbon emission target indicating part, a general card having a highest number among general cards included in the sets of four general cards determines a winner among the players, and wherein the earth money card is provided to the winner.

4. The board game according to claim 3, wherein the game rules specify that, among the general cards respectively submitted and turned over in the floor card locations, an earth money card is to be provided from a player who submitted and turned over a set of four general cards having a sum of numbers which exceeds the carbon emission target to another player, wherein the other player is:

the player who submitted and turned over the set of four general cards having the sum of numbers which does not exceed the carbon emission target and which is the highest among the sets of four general cards; or the player who submitted a general card having a lowest number among the general cards included in the sets of four general cards, based on the case in which the at least two sets of four general cards are submitted and turned over and each have a sum of numbers which does not exceed the carbon emission target indicated on the carbon emission target indicating part and which is highest among the sets of four general cards submitted by the players.

5. The board game according to claim 4, wherein the game rules specify that, among the submitted disaster card, the submitted convention card, and the sets of four general cards respectively submitted and turned over, a player who submitted and turned over the set of four general cards having a sum of numbers which exceeds the carbon emission target is to return one earth money card.

6. The board game according to claim 5, wherein the game rules specify:

the game is over after a predetermined number of rounds, a player who has a highest number of the earth money cards when the game is over is a winner, all players lose if the current value of the global warming level as indicated by the movement of the second indicator part exceeds 4 degrees, a player who has no earth money cards but has to return an earth money card due to the submitted disaster card or excess of the carbon emission target is defeated, or a player among the players is to submit an earth money card for the player who has no earth money card.

7. The board game according to claim 1, wherein for a case where the current value of the global warming level indicated by the movement of the second indicator part exceeds a predetermined temperature expressed in degrees, a disaster card is turned over from among the disaster cards and placed from the first disaster card location to the second disaster card location, and the disaster card indicates damage costs to be charged to the players.

* * * * *